US011359439B2

(12) United States Patent
Arteaga et al.

(10) Patent No.: US 11,359,439 B2
(45) Date of Patent: Jun. 14, 2022

(54) RISER RUNNING TOOL WITH LIQUID FILL AND TEST

(71) Applicant: Cameron International Corporation, Houston, TX (US)

(72) Inventors: Nicolas Arteaga, Jersey Village, TX (US); Carlos Mesquita, Houston, TX (US); Rolf Gullaksen, Richmond, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 50 days.

(21) Appl. No.: 16/598,392

(22) Filed: Oct. 10, 2019

(65) Prior Publication Data

US 2021/0108467 A1 Apr. 15, 2021

(51) Int. Cl.

| | |
|---|---|
| ***E21B 17/01*** | (2006.01) |
| ***E21B 17/08*** | (2006.01) |
| *E21B 19/00* | (2006.01) |

(52) U.S. Cl.
CPC ..... *E21B 17/01* (2013.01); *E21B 17/085* (2013.01); *E21B 19/004* (2013.01)

(58) Field of Classification Search
CPC ..... E21B 17/085; E21B 17/01
See application file for complete search history.

(56) References Cited

U.S. PATENT DOCUMENTS

| | | | | |
|---|---|---|---|---|
| 5,421,674 | A * | 6/1995 | Maloberti | F16L 11/083 405/166 |
| 8,033,335 | B2 * | 10/2011 | Orbell | E21B 17/01 166/367 |
| 9,429,010 | B2 * | 8/2016 | Winters | E21B 47/001 |
| 9,708,863 | B2 * | 7/2017 | DeBerry | E21B 17/085 |
| 10,329,841 | B2 * | 6/2019 | Van Duivendijk | E21B 15/04 |
| 2020/0256135 | A1 * | 8/2020 | Roodenburg | E21B 19/02 |
| 2021/0108469 | A1 | 4/2021 | Gullaksen et al. | |

* cited by examiner

*Primary Examiner* — Aaron L Lembo
(74) *Attorney, Agent, or Firm* — Kelly McKinney

(57) ABSTRACT

A drilling riser running system includes a water filling system and a pressure testing system that can fill and pressure test auxiliary lines of the riser system, while simultaneously running a riser joint.

18 Claims, 5 Drawing Sheets

RISER RUNNING TOOL WITH LIQUID FILL AND TEST

TECHNICAL FIELD

The present disclosure relates to systems and methods for running marine drilling riser. More specifically, the present disclosure relates to a marine riser tool configured to fill one or more external auxiliary lines of the riser with liquid and/or test such auxiliary lines.

BACKGROUND

This section is intended to introduce the reader to various aspects of art that may be related to various aspects of the present disclosure, which are described or claimed below. This discussion is believed to be helpful in providing the reader with background information to facilitate a better understanding of the various aspects of the present disclosure. Accordingly, it should be understood that these statements are to be read in this light, and not as admissions of prior art.

A drilling riser includes a relatively large-diameter pipe that connects a subsea blowout preventer (BOP) stack to a surface rig. The large-diameter pipe is configured to take mud returns to the surface. In addition to the large-diameter main tube, many drilling risers include a plurality of high-pressure external auxiliary lines. These auxiliary lines can include high pressure choke and kill lines for circulating fluids to the BOP, and usually power and control lines for the BOP.

As the drilling riser is being installed, a riser running tool is often used to grip the next section or joint of riser at its upper end while the previous joint of riser is held in place by a spider system at the drill floor. After stabbing and connecting pins and boxes of the two riser joints together, the riser running tool lowers the joint or riser through drill floor and into the sea water. Periodically, after several riser joints have been run, the auxiliary lines have to be filled with liquid to reduce risk of damage due to external sea water pressure. Additionally, the auxiliary lines are often pressure tested to detect possible leaks after a number of riser joints have been run. In order to perform the liquid filling and/or pressure testing of the auxiliary lines, one or more hoses need to be moved across the drill floor and connected. Ordinarily the connection, filling and pressure testing process is somewhat time consuming, so the filling and testing are only carried out after a predetermined number of joints have been installed. For example, in some cases the connection, filling and testing is only carried out every 8, 10 or 13 joints.

SUMMARY

This summary is provided to introduce a selection of concepts that are further described below in the detailed description. This summary is not intended to identify key or essential features of the claimed subject matter, nor is it intended to be used as an aid in determining or limiting the scope of the claimed subject matter as set forth in the claims.

According to some embodiments, a drilling riser running tool is described that is adapted to connect and run riser joints for use in a drilling process. The system includes: a riser joint interface configured to securely hold a first riser joint at a top end such that with a top drive system above the riser running tool, the first riser joint can be lowered towards a second riser joint being held by its top end near a drill floor; an auxiliary tube interface configured to provide liquid filling of a first auxiliary tube on the first riser joint after connection of the first and second riser joints; and a liquid filling system configured to provide filling of the first auxiliary tube with liquid (e.g. sea water) while the first and second riser joints are being run.

According to some embodiments, the drilling riser running tool can also include a second auxiliary tube interface configured to provide liquid filling of a second auxiliary tube on the first riser joint after connection of the first and second riser joints and while the first and second riser joints are being run.

According to some embodiments, the drilling riser running tool also includes a pressure testing system configured to pressurize the auxiliary tubes after liquid filling and test the first tubes for leaks under pressurization. According to some embodiments, the liquid filling system also includes a liquid line passing from the top drive to the auxiliary tube interface.

According to some embodiments, a method of running a riser system is described. The method includes: interfacing a riser running tool with a top end of a first riser joint, the interfacing including forming a seal between a liquid filling and testing system and auxiliary tube(s) on the first riser joint; lowering a bottom end of the first riser joint towards a top end of a second riser joint being held stationary at a drill floor; connecting the bottom end of the bottom end of the first riser joint to the top end of the second riser joint; releasing the top end of the second riser joint at the drill floor and running the first and second riser joints downwards; and while running the first and second riser joints, filling the auxiliary tube(s) with liquid. According to some embodiments, the method can also include pressure testing the auxiliary tube(s) while running the riser joints.

BRIEF DESCRIPTION OF THE DRAWINGS

The subject disclosure is further described in the following detailed description, and the accompanying drawings and schematics of non-limiting embodiments of the subject disclosure. The features depicted in the figures are not necessarily shown to scale. Certain features of the embodiments may be shown exaggerated in scale or in somewhat schematic form, and some details of elements may not be shown in the interest of clarity and conciseness.

DETAILED DESCRIPTION

Figure 1:
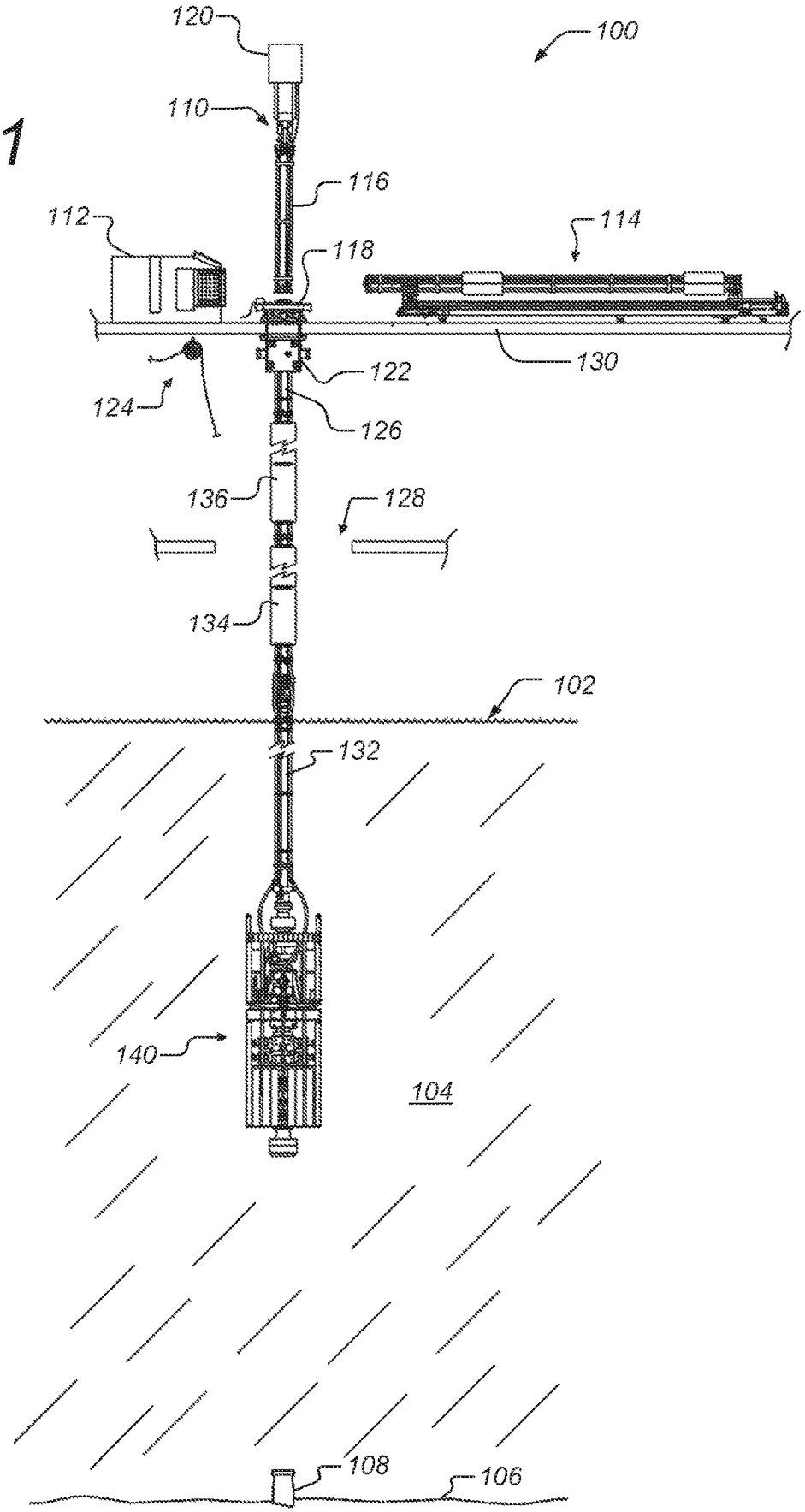
FIG. 1 shows a drilling system with an improved riser running tool is deployed at a marine wellsite, according to some embodiments.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure. Like reference numerals are used herein to represent identical or similar parts or elements throughout several diagrams and views of the drawings.

According to some embodiments, an enhanced riser running tool is described that is configured to perform sea water fill up and pressure testing of the riser auxiliary lines. Once connected, the riser running tool is capable of filling up the auxiliary lines while tripping down the riser joint, and then run a pressure test when the lines are filled up with water.

FIG. 1 shows a drilling system with an improved riser running tool deployed at a marine wellsite, according to some embodiments. The drilling system 100 is being deployed on a vessel, such as a drillship, or on a floating platform positioned above subsea wellhead 108 on sea floor 106. According to some other embodiments, the drilling system 100 is being deployed from a fixed platform above wellhead 108. Drilling system 100 is shown lowering BOP stack 140 down through sea water 104 for connection to wellhead 108. The BOP stack 140 can include various components such as a wellhead connector, blowout preventors, annular diverters, subsea flexjoint(s) and riser adapter(s). Above BOP stack 140 are a number of riser joints below seawater surface 102 of which riser joint 132 is shown. Shown below drill floor 130 and passing through moon pool door 128 are further riser joints 134, 136 and 126. Riser joints 134 and 136 are shown with buoyancy modules. Mux cable line 124 is also shown being deployed below drill floor 130. Diverter 122 is also visible below rotatory table and drill floor 130. Above the drill floor 130 is "dog house" 112 and spider 118, which is shown currently holding the uppermost flange of riser joint 126. The riser running tool 110 is shown holding the next riser joint 116 above the spider 118. The riser running tool 110 is being deployed by top drive system 120. Also shown on the right side is a new riser joint 114 in the horizontal position that can be deployed by the riser running tool following the attachment of riser joint 116 to riser joint 126 and the lowering or running of riser joint 116.

Figure 2:
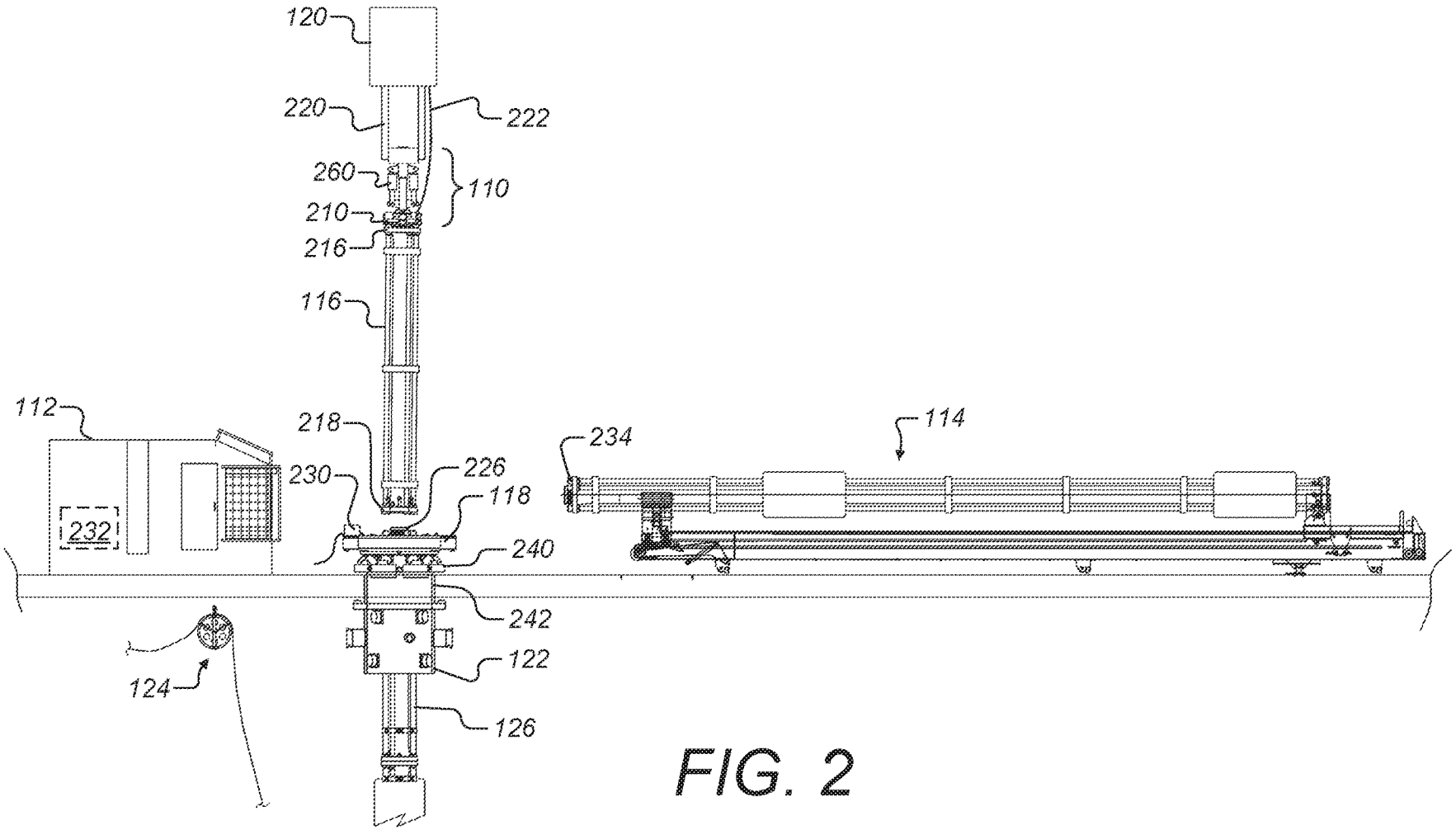
FIG. 2 shows further detail of a drilling system with an improved riser running tool being deployed at a marine wellsite, according to some embodiments.

FIG. 2 shows further detail of a drilling system with an improved riser running tool being deployed at a marine wellsite, according to some embodiments. In FIG. 2, the rotary table 242 and the gimbal 240 are visible. Also visible is the upper most portion 226 of lower riser joint 126 that is being held by spider 118. An alignment module 230 is also shown mounted on spider 118 which can be configured to facilitate automatic rotational alignment between the lower riser joint 126 and upper riser joint 116, and reduce risk of damage as is described in further detail in the co-pending patent application entitled "Riser Running Tool with Automated Alignment and Load Compensation," filed on even date herewith, hereinafter referred to as the "co-pending patent application," and which is incorporated herein by reference. A processing system 232 is shown in "dog house" 112, although it could be located in part or wholly in another location at the drill site. According to some embodiments, processing system 232 includes a general-purpose data processor and other computer components such as storage and input/output modules and is configured to carry out control processing tasks including the water fill-up and/or pressure test of the auxiliary lines.

At the upper end of riser joint 116, tool head module 210 of riser running tool 110 is shown engaging and holding riser joint 116 at its upper end 216. A hydraulic and test fluid supply line 222 is run from the top drive 120 to the riser running tool 110 and is configured to supply hydraulic power and control as well as to supply filling and pressure testing fluid to the riser auxiliary lines. Also visible in FIG. 2 are bale arms (including bale arm 220) and weight compensation pistons (including piston assembly 260) which can be used to facilitate weight/load compensation to reduce the risk of damage, as is described in further detail in the co-pending patent application.

Figure 3:
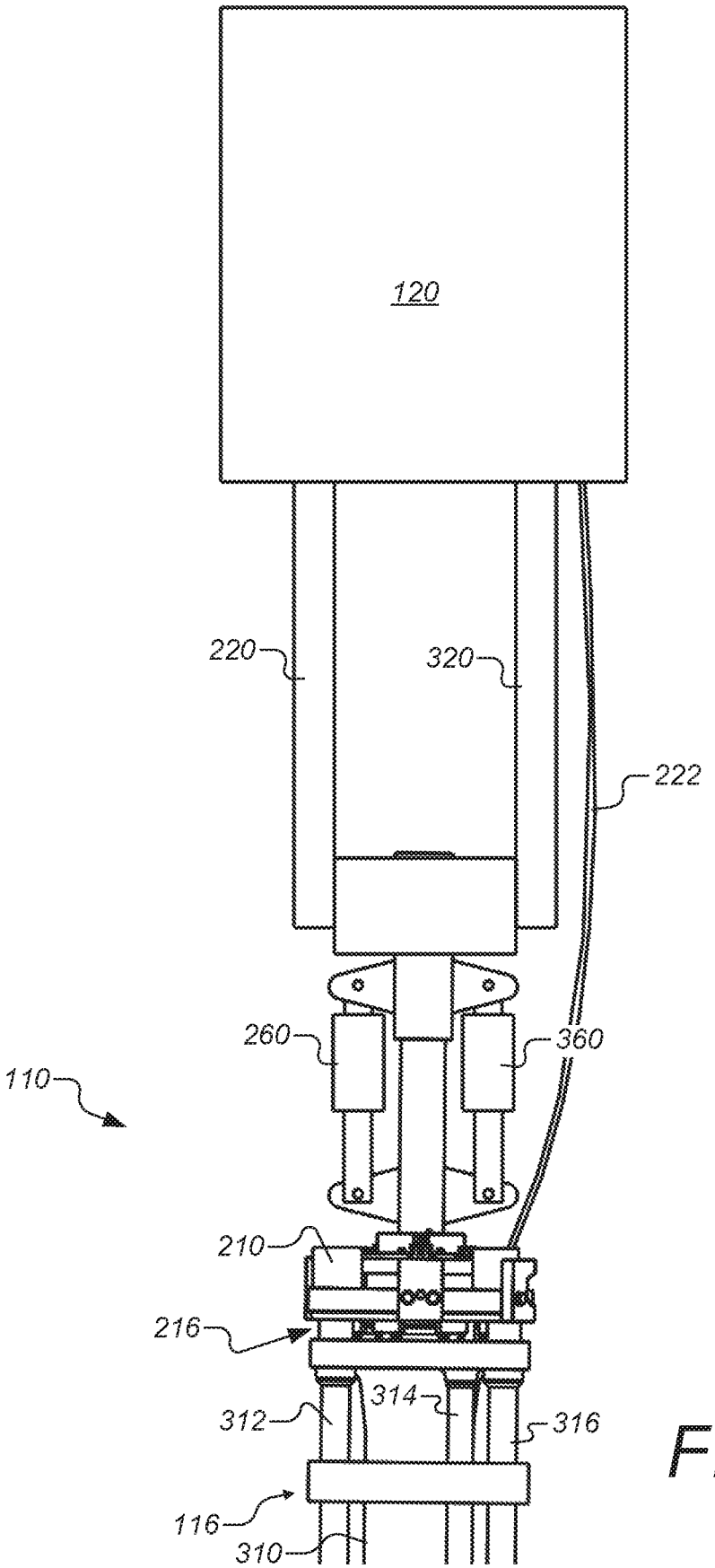
FIG. 3 shows further detail of an improved riser running tool, according to some embodiments.

FIG. 3 shows further detail of an improved riser running tool, according to some embodiments. Tool head module is shown engaged with upper end 216 of riser joint 116. Riser joint 116 includes a large central tube 310 configured to carry fluid such as drilling mud from the wellhead to the surface. Riser joint 116 also includes a number of auxiliary lines 312, 314 and 316, which can include high pressure choke and kill lines for circulating fluids to the BOP, as well as power and control lines for BOP operation. According to some embodiments, tool head 210 grips onto the riser joint 116 by inserting a portion into the box section of the main tube 310 and expanding a split ring that engages grooves on the inner portion of the main tube 310. Also, visible more clearly in FIG. 3 is the second bale arm 320 and the second piston assembly 360.

Figure 4:
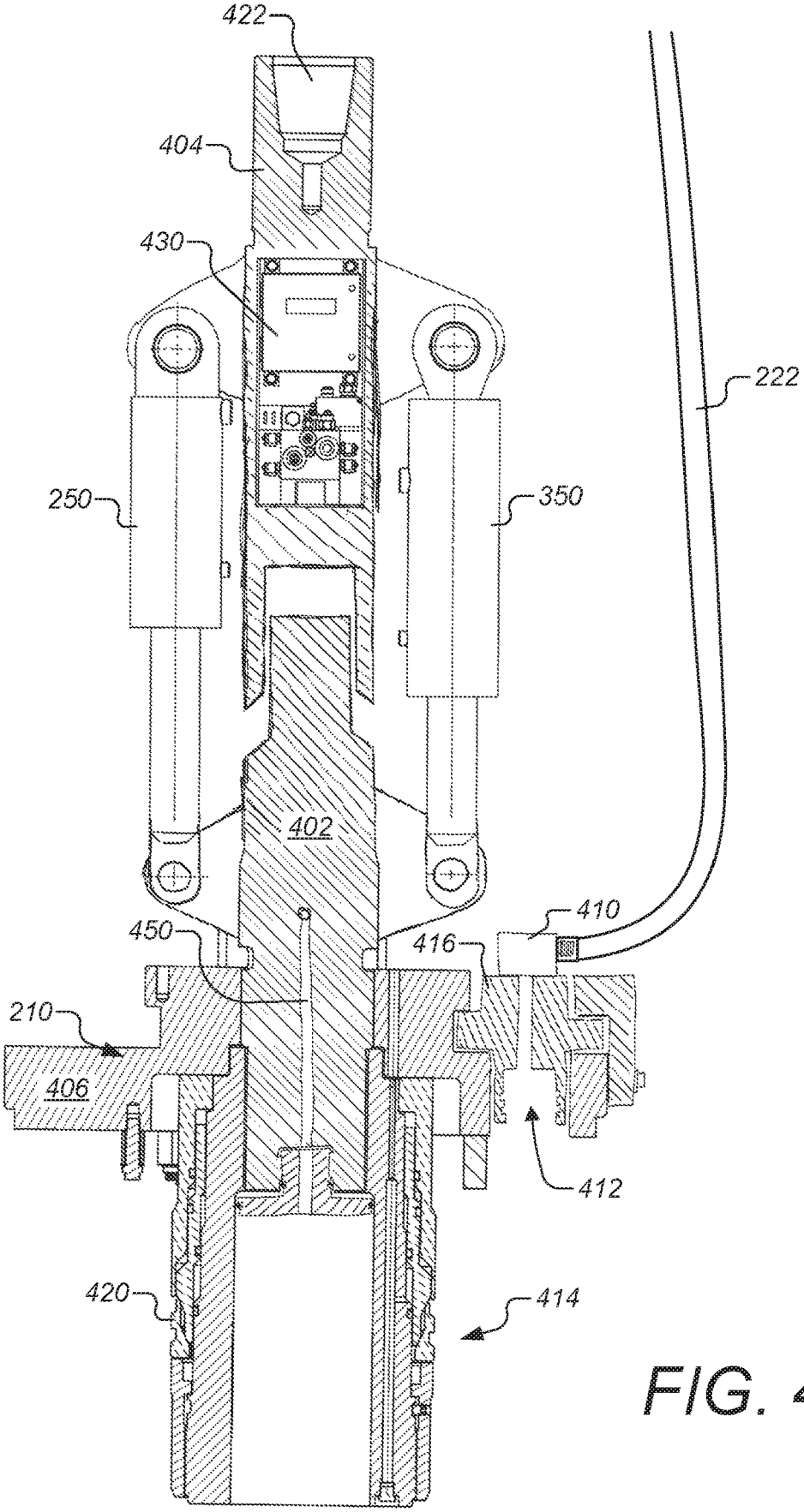
FIG. 4 is a partial cross section illustrating further detail of an improved riser running tool, according to some embodiments.

FIG. 4 is a partial cross section illustrating further detail of an improved riser running tool, according to some embodiments. The lower portion of tool 210 includes riser bore pin assembly 414 that is shaped to fit into the box section of each riser joint's main central tube. The assembly 414 includes a split ring 420 that can be expanded under hydraulic power (e.g. from line 222, although the hydraulic connection is not shown). When split ring 420 is expanded, protrusions on the split ring outer surface securely engage grooves on the inner portion of the riser's main bore such that the riser can be safely and securely lifted and positioned for deployment (or storage). Also shown is a main bore vent line 450 that is configured to provide testing of the main riser tubing. According to some embodiments, the riser running tool can be configured to perform pressure testing on the main riser bore (e.g. tube 310 shown in FIG. 3). In cases where testing of the main riser bore is being tested sealing can be provided between assembly 414 and the inner surface of central tube 310 (shown in FIG. 3).

Auxiliary line testing subassembly 416 includes a box 412 to automatically engage the upper pin of an auxiliary line (e.g. line 316 shown in FIG. 3). The box 412 is configured to form a seal with the auxiliary line when the central pin assembly 414 is engaged with the central tube (e.g. tube 310 shown in FIG. 3). Testing subassembly 416 includes a fluid port 410 that is attached to line 222 as shown. While only a single testing subassembly 416 is shown for clarity in FIG. 4, according to some embodiments, riser running tool head 210 includes a plurality of testing subassemblies that matches the number of auxiliary lines being used with the particular riser being run. For example, in many cases the riser system will include five auxiliary lines and in this case the tool head 210 will include five testing subassemblies 416, each being connected to a fluid supply line 222. According to some embodiments, line 222 includes separate fluid supply lines running to each of the testing subassemblies. For example, in the case there are five auxiliary lines and tool head 210 includes five testing subassemblies 416, then line 222 includes five separate fluid supply channels with one running to each of the five testing subassemblies. Running separate supply lines can increase flow rate and reduce fill-up time. Each of the testing subassemblies is configured to automatically sealingly connect to the respective auxiliary line upon engagement between the central pin assembly 414 and the central tube (e.g. tube 310 shown in FIG. 3). By automatically forming sealed fluid communication with each auxiliary line in the riser joint, filling and testing of the auxiliary lines can commence as soon as the riser joint is "latched" or fixed (e.g. with bolts) to the riser being held in the spider.

Also shown in FIG. 4 is the central body of the riser running tool being separated into two sections: lower section 402 and upper section 404. Relative movement between the two sections 402 and 404 is controlled by piston assemblies 250 and 350, as well as the external forces from the top drive and the attached riser joint(s). A hydraulic control system 430 is included that is configured to measure and control the hydraulic pressure in the piston assemblies 250 and 350 for facilitating weight/load compensation, as is described in further detail in the co-pending patent application. According to some embodiments, the upper section 404 has a box connection 422 that is configured to interface with the saver sub on the top drive system (e.g. NC50 threaded box connection).

Figure 5:
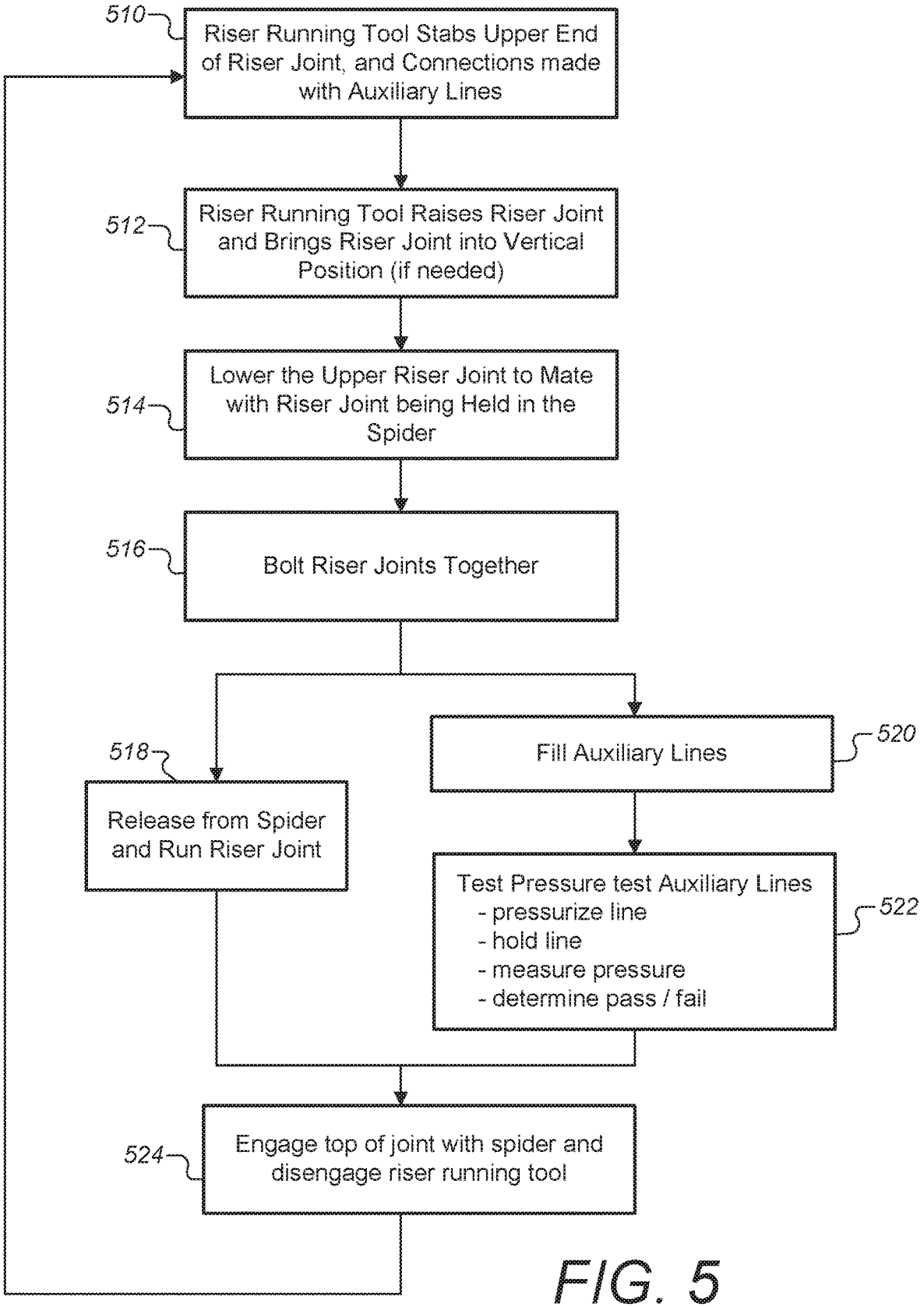
FIG. 5 is a block diagram illustrating further details relating to operating a riser running tool, according to some embodiments.

FIG. 5 is a block diagram illustrating further details relating to operating a riser running tool, according to some embodiments. In block 510, the riser running tool stabs and engages the upper end of the next riser joint to be installed. In some cases, the next riser joint will be in a horizontal position (such as joint 114 shown in FIGS. 1 and 2), and other cases it might be in a vertical position. In some cases, the engagement takes place by radially expanding of a split ring such as split ring 420 shown in FIG. 4 where the raised portions of the split ring engage and lock on to matching grooves formed on the inner portion of the main tubing of the riser joint. Also performed along with the engagement of the central riser bore, fluid connections are made with each of the auxiliary lines of the riser joint. This can be made, for example, by engagement of each testing subassembly (such as testing sub 416 shown in FIG. 4) with each auxiliary line. In block 512, the riser running tool and the top drive system, raises and positions the riser joint such that lower end of the riser joint is above the upper end of riser joint being held by the spider. In cases where it is in a horizontal position, this step includes bringing the riser joint into vertical alignment. In block 514, the top drive lowers the riser running tool and riser joint being held to mate with the lower riser joint being held in the spider. In block 516 the two riser joints are fixed or "latched" together, such as with bolts. Once the two joints are latched, the filling and testing of the auxiliary line can commence (blocks 520 and 522). Note that the filling and testing of the auxiliary lines can take place in parallel with the releasing of the riser from the spider and lowering or running of the riser (block 518). The test procedure (block 522) includes steps according to the specification of the line and generally includes pressurising the line to a predetermined level, holding or waiting for at the pressure for a predetermined length of time while measuring any pressure loss. Based on the measurements the test is passed or failed. Assuming no test failure, in block 524 the top of the joint is held by the spider and the riser running tool is disengaged. Note that the liquid fill (block 520) and/or the pressure test (block 522) can be optionally performed for each joint, or they can be performed after a number of joints. In one example, the auxiliary lines are filled for every joint and the test is performed only every other joint (or every third joint, etc.). In another example, the auxiliary lines are filled and tested only every other joint. The ability to fill and test auxiliary lines with much greater flexibility can result in significant cost savings due to a reduced risk of leaks since filling of the auxiliary lines occurs more often. Furthermore, significant cost savings can result from improved leak detection; since testing more frequently means leaks are often detected earlier leading to reduced cost of repair.

Although most of the foregoing has been described with respect to marine drilling risers, according to some embodiments the techniques described herein are applied to other types or risers such as tie-back drilling riser and production riser that have auxiliary tubes or lines.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for" or "step for" performing a function, it is intended that such elements are to be interpreted under 35 U.S.C. 112(f). However, for any claims containing elements designated in any other manner, it is intended that such elements are not to be interpreted under 35 U.S.C. 112(f). While the subject disclosure is described through the above embodiments, it will be understood by those of ordinary skill in the art, that modification to and variation of the illustrated embodiments may be made without departing from the concepts herein disclosed.

What is claimed is:

1. A system, comprising:

a top drive system; and a drilling riser running tool adapted to connect and run riser joints for use in a drilling process, the drilling riser running tool comprising:

a riser joint interface configured to securely hold a first riser joint at a top end such that with the top drive system above the drilling riser running tool, the first riser joint can be lowered towards a second riser joint being held near a drill floor;

an auxiliary tube interface configured to couple a fluid line to a first auxiliary tube on the first riser joint upon connection of the drilling riser running tool and the first riser joint; and a liquid filling system configured to provide liquid filling of the first auxiliary tube via the fluid line after connection of the first and second riser joints and while the first and second riser joints are being run.

2. The system according to claim 1, wherein the drilling riser running tool further comprises a second auxiliary tube interface configured to couple an additional fluid line to a second auxiliary tube on the first riser joint upon the connection of the drilling riser running tool and the first riser joint, and wherein the liquid filling system is further configured to provide liquid filling of the second auxiliary tube via the additional fluid line after the connection of the first and second riser joints and while the first and second riser joints are being run.

3. The system according to claim 1, wherein the drilling riser running tool further comprises a pressure testing system configured to:

pressurize the first auxiliary tube after the liquid filling of the first auxiliary tube; and test the first auxiliary tube for leaks under pressurization, and wherein the auxiliary tube interface is further configured to automatically form a seal with the first auxiliary tube.

4. The system according to claim 3, wherein the drilling riser running tool further comprises a second auxiliary tube interface configured to automatically form a respective seal with a second auxiliary tube on the first riser joint and to couple an additional fluid line to the second auxiliary tube upon the connection of the drilling riser running tool and the first riser joint, wherein the liquid filling system is further configured to provide liquid filling of the second auxiliary tube via the additional fluid line after the connection of the first and second riser joints and while the first and second riser joints are being run, and the pressure testing system further is configured to pressurize the second auxiliary tube and test the second auxiliary tube for leaks under pressurization.

5. The system according to claim 1, wherein the liquid filling system includes the fluid line passing from the top drive system to the auxiliary tube interface.

6. The system according to claim 1, wherein the auxiliary tube interface includes a box interface configured to sealingly engage a pin on a top end of the first auxiliary tube.

7. The system according to claim 1, wherein the riser joint interface includes a split ring configured to expand and engage an inner surface of a main central tube of the first riser joint.

8. The system according to claim 1, wherein the liquid used to fill the first auxiliary tube is sea water.

9. A drilling riser running tool according to claim 1 wherein the liquid filling system is configured to provide the liquid filling of the first auxiliary tube via the fluid line while the second riser joint is being released from the drill floor.

10. A drilling riser running tool according to claim 1 wherein the liquid filling system is configured to test the first auxiliary tube for leaks under pressurization after the liquid filling of the first auxiliary tube and while the first and second riser joints are being run.

11. A drilling riser running tool according to claim 1 wherein the liquid filling system comprises a processor configured to control the liquid filling of the first auxiliary tube.

12. A drilling riser running tool according to claim 1 wherein the auxiliary tube interface is configured to sealingly engage the first auxiliary tube upon engagement between the riser joint interface and the top end of the first riser joint.

13. A method of running a riser system, the method comprising:

providing a top drive system;

below the top drive system, interfacing a riser running tool with a top end of a first riser joint, the interfacing including forming a seal between a liquid filling and testing system and a first auxiliary tube on the first riser joint;

lowering a bottom end of the first riser joint towards a top end of a second riser joint being held stationary at a drill floor;

connecting the bottom end of the first riser joint to the top end of the second riser joint;

releasing the top end of the second riser joint at the drill floor and running the first and second riser joints downwards; and while running the first and second riser joints, filling the first auxiliary tube with liquid via the liquid filling and testing system.

14. A method of running a riser system according to claim 13 further comprising:

pressurizing the first auxiliary tube after filling the first auxiliary tube; and testing the first auxiliary tube for leaks under pressurization.

15. A method of running a riser system according to claim 13 wherein the interfacing includes forming a respective seal between the liquid filling and testing system and a second auxiliary tube on the first riser joint, the method further comprising:

while running the first and second riser joints, filling the second auxiliary tube with liquid via the liquid filling and testing system;

pressurizing the second auxiliary tube after filling the second auxiliary tube; and testing the second auxiliary tube for leaks under pressurization while running the first and second riser joints.

16. A method of running a riser system according to claim 15 wherein the interfacing comprises forming the seal between the liquid filling and testing system and the first auxiliary tube upon engagement between a central pin assembly of the riser running tool and a central tube at the top end of the first riser joint.

17. A system, comprising:

a top drive system; and a drilling riser running tool adapted to connect and run riser joints for use in a drilling process, the drilling riser running tool comprising:

a riser joint interface configured to securely hold a first riser joint at a top end such that with the top drive system above the drilling riser running tool, the first riser joint can be lowered towards a second riser joint being held near a drill floor;

an auxiliary tube interface configured to couple a fluid line to a first auxiliary tube on the first riser joint; and a liquid filling system comprising the fluid line passing from the top drive system to the auxiliary tube interface, wherein the liquid filling system is configured to provide liquid filling of the first auxiliary tube via the fluid line.

18. The system according to claim 17, wherein the liquid filling system is configured to provide the liquid filling of the first auxiliary tube via the fluid line after connection of the first and second riser joints and while the first and second riser joints are being run.

* * * * *